US008050617B2

(12) United States Patent
Suzuki

(10) Patent No.: US 8,050,617 B2
(45) Date of Patent: Nov. 1, 2011

(54) IMAGE FORMING APPARATUS

(75) Inventor: Shiro Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 11/907,069

(22) Filed: Oct. 9, 2007

(65) Prior Publication Data

US 2008/0181694 A1 Jul. 31, 2008

(30) Foreign Application Priority Data

Jan. 30, 2007 (JP) ..... 2007-019121

(51) Int. Cl.
*G03G 15/00* (2006.01)

(52) U.S. Cl. ..... 399/397; 399/391

(58) Field of Classification Search ..... 399/397, 399/391

See application file for complete search history.

(56) References Cited

U.S. PATENT DOCUMENTS

| | | | | |
|---|---|---|---|---|
| 5,048,264 | A * | 9/1991 | Frohlich | 53/430 |
| 5,125,330 | A * | 6/1992 | Reist | 100/35 |
| 5,162,857 | A * | 11/1992 | Higeta et al. | 399/401 |
| 5,570,172 | A * | 10/1996 | Acquaviva | 399/403 |
| 5,678,138 | A * | 10/1997 | Kobayashi et al. | 399/18 |
| 6,226,473 | B1 * | 5/2001 | Kutsuwada | 399/82 |
| 7,242,417 | B2 * | 7/2007 | Nishitani et al. | 347/218 |
| 7,245,870 | B2 * | 7/2007 | Ozaki | 399/388 |
| 2002/0060416 | A1 * | 5/2002 | Dobberstein et al. | 271/227 |
| 2007/0014611 | A1 * | 1/2007 | Nakamura et al. | 399/407 |

FOREIGN PATENT DOCUMENTS

| | | |
|---|---|---|
| JP | 6-91592 | 4/1994 |
| JP | 8-106194 | 4/1996 |
| JP | 2001-315398 | 11/2001 |
| JP | 2005-99261 | 4/2005 |
| JP | 2005-165112 | 6/2005 |
| JP | 2005-205900 | 8/2005 |

* cited by examiner

*Primary Examiner* — Anthony H. Nguyen

(74) *Attorney, Agent, or Firm* — Morgan, Lewis & Bockius LLP

(57) ABSTRACT

An image forming apparatus includes: a conveyance unit that conveys plural single cut-sheet recording media arrayed along a direction orthogonal to a conveyance direction; and an image forming unit that forms an image on the plural single cut-sheet recording media conveyed by the conveyance unit.

12 Claims, 10 Drawing Sheets

NUMBER OF PRINTED SHEETS PER MINUTE: 100
PROCESS SPEED: 516.7 [mm/sec]

SHEET CONVEYANCE DIRECTION

NUMBER OF PRINTED SHEETS PER MINUTE: 100
PROCESS SPEED: 330.8 [mm/sec]

SHEET CONVEYANCE DIRECTION

NUMBER OF PRINTED SHEETS PER MINUTE: 100
PROCESS SPEED: 258.3 [mm/sec]

SHEET CONVEYANCE DIRECTION

NUMBER OF PRINTED SHEETS PER MINUTE: 100
PROCESS SPEED: 220.6 [mm/sec]

SHEET CONVEYANCE DIRECTION

NUMBER OF PRINTED SHEETS PER MINUTE (A4) : 39
NUMBER OF PRINTED SHEETS PER MINUTE (A3) : 39
PROCESS SPEED: 258.3 [mm/sec]

SHEET CONVEYANCE DIRECTION

NUMBER OF PRINTED SHEETS PER MINUTE (A4) : 43
NUMBER OF PRINTED SHEETS PER MINUTE (A3) : 33
PROCESS SPEED: 220.6 [mm/sec]

SHEET CONVEYANCE DIRECTION

SHEET CONVEYANCE DIRECTION

IMAGE FORMING APPARATUS

CROSS-REFERENCE TO RELATED APPLICATIONS

This application is based on and claims priority under 35 USC 119 from Japanese Patent Application No. 2007-019121 filed Jan. 30, 2007.

BACKGROUND

1. Technical Field

The present invention relates to an image forming apparatus such as a printer, a facsimile machine and a copier.

2. Related Art

Generally, when an image forming apparatus of this type performs high speed processing, it is necessary to increase a process speed. However, the performance of marking and the performance of a driving system are limited.

SUMMARY

There is provided an image forming apparatus including: a conveyance unit that conveys plural single cut-sheet recording media arrayed along a direction orthogonal to a conveyance direction; and an image forming unit that forms an image on the plural single cut-sheet recording media conveyed by the conveyance unit.

BRIEF DESCRIPTION OF THE DRAWINGS

Exemplary embodiments of the present invention will be described in detail based on the following figures, wherein.

DETAILED DESCRIPTION

FIGS. 1A to 1D are explanatory views showing arrangements of sheet conveyance in an image forming apparatus according to the exemplary embodiment, and the relation between the number of printed sheets and process speed in the respective arrangements.

As shown in FIGS. 1A to 1D, in the image forming apparatus according to the exemplary embodiment, when plural single cut-sheet recording media are conveyed, they are arrayed in a direction orthogonal to a sheet conveyance direction. Note that the single cut-sheet recording medium is a recording medium in a predetermined sheet size, i.e., a single cut sheet (cut sheet) such as a paper sheet or an OHP sheet. The predetermined size is e.g., A4 size or A3 size defined by Japan Industrial Standards. Accordingly, the single cut-sheet recording medium is different from a roll sheet.

Figure 1A:
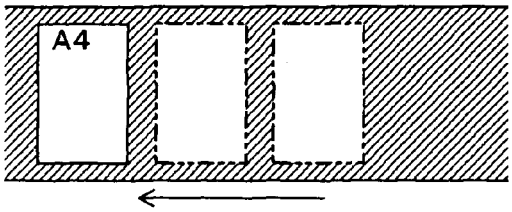
FIGS. 1A to 1D are explanatory views showing arrangements of sheet conveyance in an image forming apparatus according to the exemplary embodiment, and the relation between the number of printed sheets and process speed in the respective arrangements.

FIG. 1A shows A4-sized cut sheets in LEF (Long Edge Feed) status. "LEF" means conveyance of a sheet with its short side along a sheet conveyance direction. Note that in such case, this status can be expressed that the sheet is "A4LEF".

Figure 1B:
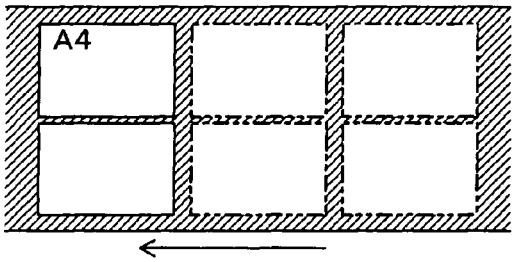
Figure 1C:
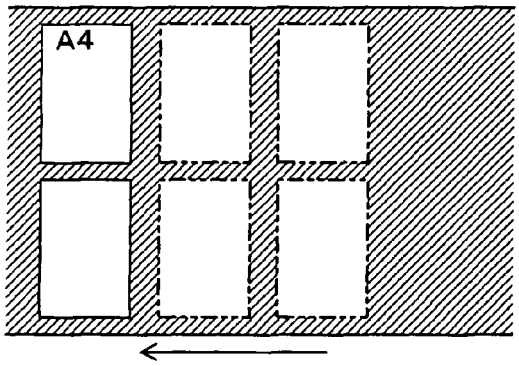
Figure 1D:
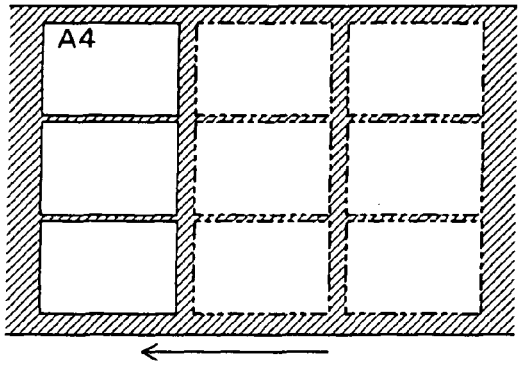

As shown in FIG. 1A, when the sheets are A4LEF, assuming that the interval between the sheets is 100 mm and the number of printed sheets per minute is 100, the process speed is 516.7 mm/sec (31,000 mm/min). The short side of the A4 sheet is 210 mm. In FIGS. 1B to 1D, the interval between the sheets and the number of printed sheets per minute are the same as the conditions in FIG. 1A.

FIG. 1B shows A4-sized cut sheets in SEF (Short Edge Feed) status, conveyed by two sheets in parallel. "SEF" means conveyance of a sheet with its long side along a sheet conveyance direction. Note that in such case, this status can be expressed that the sheet is "A4SEF".

As shown in FIG. 1B, when the sheets are A4SEF and conveyed by two sheets in parallel, the process speed is 330.8 mm/sec (19.850 mm/min). The long side of the A4 sheet is 297 mm.

FIG. 1C shows A4LEF sheets conveyed by two sheets in parallel. In this case, as shown in FIG. 1C, the process speed is 258.3 mm/sec (15.500 mm/min). FIG. 1D shows A4SEF sheets conveyed by three sheets in parallel. In this case, as shown in FIG. 1D, the process speed is 220.6 mm/sec (13233.3 mm/min).

In this manner, upon conveyance of sheets, when the sheets are arrayed in the direction orthogonal to the sheet conveyance direction, the process speed may be lower in comparison with conveyance of sheets one by one. Further, in a case where the process speeds are the same, when plural sheets are conveyed in parallel, the number of printed sheets per minute is larger than the conveyance of sheets one by one.

Note that in the image forming apparatus according to the exemplary embodiment, the sheet size may be A3, B5 or the like other than A4.

Figure 2A:
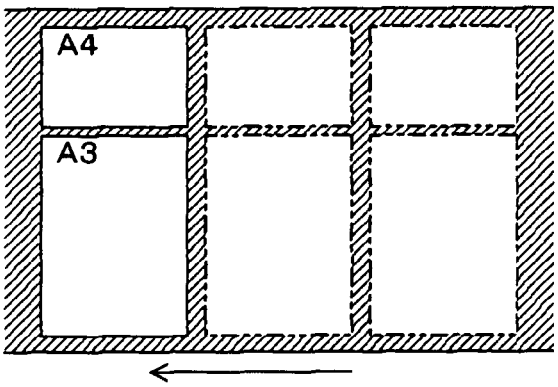
FIGS. 2A to 2C are explanatory views showing other arrangements of sheet conveyance in the image forming apparatus according to the exemplary embodiment.
Figure 2B:
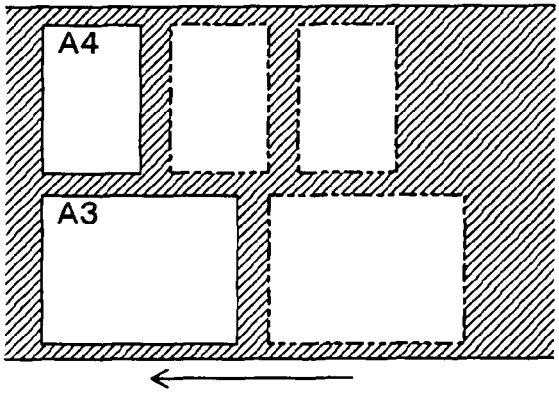
Figure 2C:
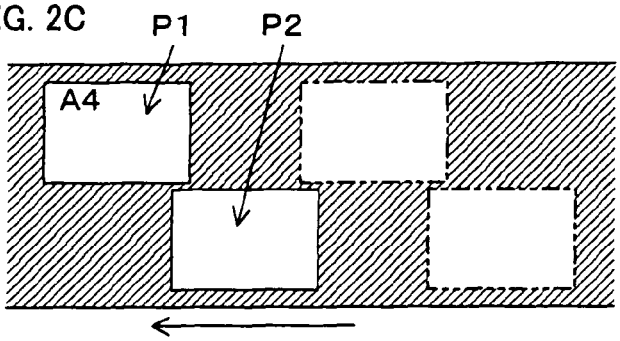

FIGS. 2A to 2C are explanatory views showing other arrangements of sheet conveyance in the image forming apparatus according to the exemplary embodiment.

FIGS. 2A and 2B show conveyance of plural sheets in different sizes in parallel. FIG. 2A shows conveyance of sheets in a smaller size (first size sheets) with their long sides along the conveyance direction, and sheets in a larger size (second size sheets) with their short sides along the conveyance direction. For example, as shown in FIG. 2A, A4SEF sheets and A3LEF sheets are conveyed in parallel. In this case, assuming that the process speed is 258.3 mm/sec, the number of printed A4SEF sheets and that of printed A3LEF sheets per minute are respectively 39.

FIG. 2B shows conveyance of the sheets in the smaller size (first size sheets) with their short sides along the conveyance direction, and the sheets in the larger size (second size sheets) with their long sides along the conveyance direction. For example, as shown in FIG. 2B, A4LEF sheets and A3SEF sheets are conveyed in parallel. In this case, assuming that the process speed is 220.6 mm/sec, the number of printed A4LEF sheets per minute is 43, and that of printed A3SEF sheets is 33.

FIG. 2C shows conveyance of plural sheets in parallel at different timings. As shown in FIG. 2C, the plural sheets are conveyed such that they overlap with each other in at least one part in a sheet conveyance direction. For example, a rear end of a sheet P1 is positioned behind a front end of a sheet P2 in the sheet conveyance direction.

Figure 3:
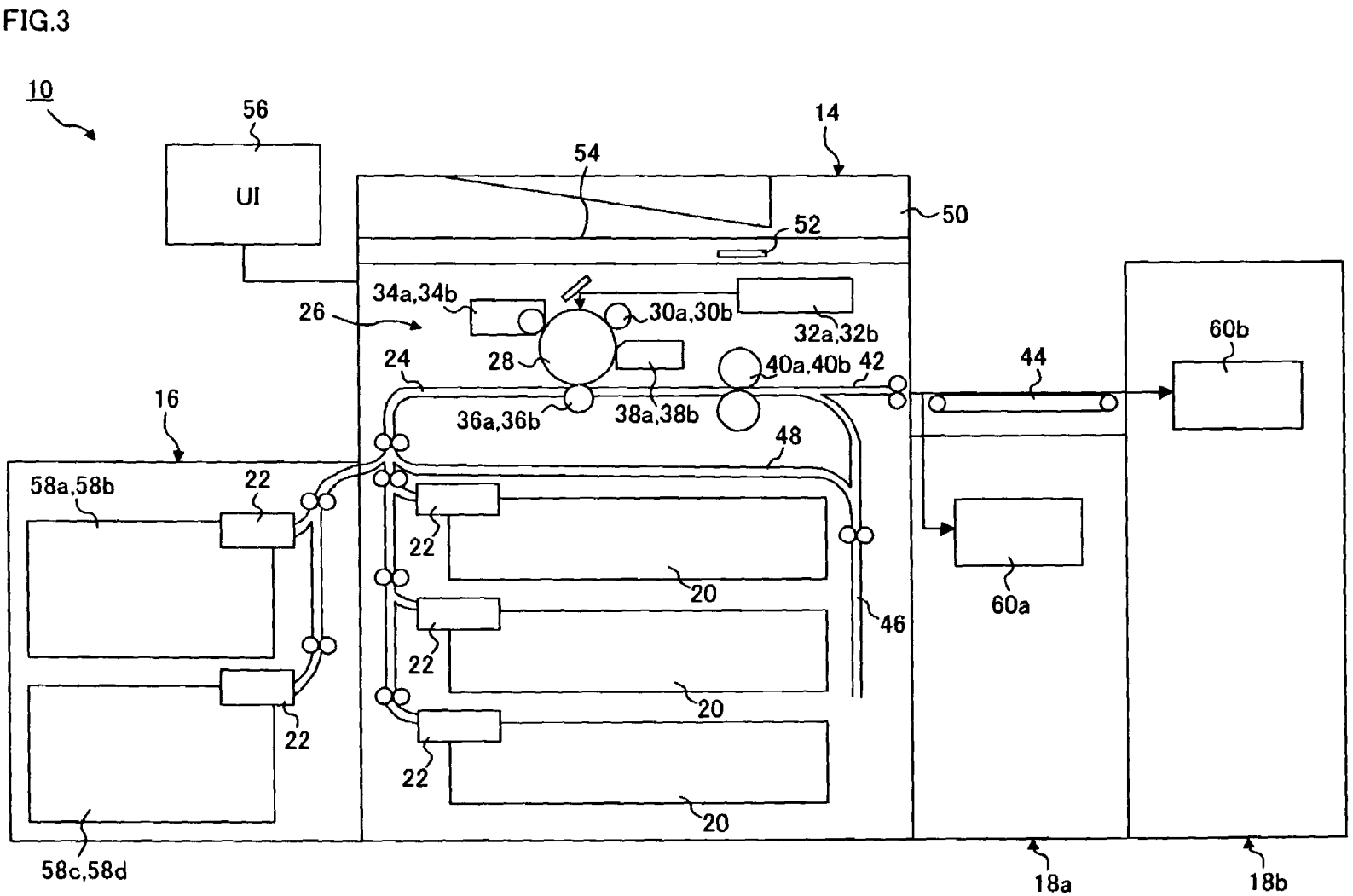
FIG. 3 is a cross-sectional view schematically showing the structure of an image forming apparatus 10 according to a first exemplary embodiment of the present invention.

FIG. 3 is a cross-sectional view schematically showing the structure of an image forming apparatus 10 according to a first exemplary embodiment of the present invention.

As shown in FIG. 3, the image forming apparatus 10 has an image forming apparatus main body 12, an image reading device 14, an external sheet supply device 16 and post processing devices 18*a* and 18*b*. The image forming apparatus 10 may be a multi-function apparatus having a printer function to print-output image data received from an external terminal device such as a personal computer (not shown), a copier function using the image reading device 14, and a facsimile function.

The image forming apparatus main body 12 has sheet supply parts 20 in e.g. 3 stages, and a supply head 22 is provided in the respective sheet supply parts 20. When one of the sheet supply parts 20 is selected, the supply head 22 is actuated, to supply a sheet from the selected sheet supply part 20 via a sheet conveyance path 24 to an image forming part 26.

The sheet conveyance path 24 is employed to convey sheets, supplied from the sheet supply part 20 and the external sheet supply device 16 to be described later, one by one, or in parallel. The sheet conveyance path 24 serves as a conveyance unit to convey plural sheets arrayed in a direction orthogonal to a conveyance direction. The width of the sheet conveyance path 24 is wider than the width of the parallel-arrayed plural sheets. For example, when two A4LEF sheets or an A4LEF and an A3SEF sheets are conveyed, the width of the sheet conveyance path 24 is at least 594 mm. Further, when three A4LEF sheets are conveyed, the width of the sheet conveyance path 24 is at least 630 mm.

The image forming part 26 having e.g. a xerography machine, forms images on plural sheets conveyed on the sheet conveyance path 24. More particularly, the image forming part 26 has an image holder 28, plural charging rollers 30*a* and 30*b* to uniformly charge the surface of the image holder 28, plural laser writing devices 32*a* and 32*b* to write latent images on the image holder 28, plural developing devices 34*a* and 34*b* to develop the written latent images, plural transfer rollers 36*a* and 36*b* to transfer the developed toner images onto the sheets, plural cleaners 38*a* and 38*b* to remove residual toner, and fixing devices 40*a* and 40*b* to fix the toner images onto the sheets. In this example, in the image forming part 26, the charging roller 30*a*, the laser writing device 32*a*, the developing device 34*a*, the transfer roller 36*a* and the cleaner 38*a* are provided on the right side to the sheet conveyance direction (front side in FIG. 3), whereas the charging roller 30*b*, the laser writing device 32*b*, the developing device 34*b*, the transfer roller 36*b* and the cleaner 38*b*, on the left side to the sheet conveyance direction (back side in FIG. 3).

When the surface of the image holder 28 is charged with the charging rollers 30*a* and 30*b*, the respective laser writing devices 32*a* and 32*b* write latent images in different positions in an axial direction of the image holder 28. Accordingly, on the right side of the sheet conveyance direction in the image holder 28, the latent image is developed with the developing device 34*a*, then transferred with the transfer roller 36*a* onto the sheet conveyed on the right side of the sheet conveyance path 24, then fixed with the fixing device 40*a*, and discharged from a sheet discharge path 42 via one of the post processing devices 18*a* and 18*b* to a sheet discharge tray (not shown). Similarly, on the left side of the sheet conveyance direction in the image holder 28, the latent image is developed with the developing device 34*b*, then transferred with the transfer roller 36*b* onto the sheet conveyed on the left side of the sheet conveyance path 24, then fixed with the fixing device 40*b*, and discharged from the sheet discharge path 42 via one of the post processing devices 18*a* and 18*b* to the sheet discharge tray (not shown).

When double sided printing is set, sheets with their one surfaces fixed with the fixing device 40*a* and 40*b* are sent from the sheet discharge path 42 to a reverse device 46 and are reversed with the reverse device 46, then sent to a sheet reverse path 48, then returned to the sheet conveyance path 24, sent to the image forming part 26 and are subjected to printing on their other surfaces. Note that the width of the sheet discharge path 42 and that of the sheet reverse path 48 are set as in the case of the sheet conveyance path 24.

The external sheet supply device 16 has e.g. right and left two stage sheet supply parts 58*a*, 58*b*, 58*c* and 58*d*. In this example, on the right side to the image forming apparatus main body 12, the sheet supply part 58*a* is provided on an upper stage, and the sheet supply part 58*c* is provided on a lower stage, whereas on the left side, the sheet supply part 58*b* is provided on the upper stage, and the sheet supply part 58*d* is provided on the lower stage. As in the case of the sheet supply part 20, the supply head 22 is provided in these sheet supply parts 58*a* to 58*d*. When a selection is made among the sheet supply parts 58*a* to 58*d*, the supply head 22 is actuated, to supply sheets via the sheet conveyance path 24 from at least the selected one of the sheet supply parts 58*a* to 58*d* to the image forming part 26. In this example, sheets are supplied from the sheet supply parts 58*a* and 58*c* to the right side of the sheet conveyance path 24, and sheets are supplied from the sheet supply parts 58*b* and 58*d* to the left side of the sheet conveyance path 24. In this manner, the external sheet supply device 16 supplies plural sheets, to be conveyed on the sheet conveyance path 24 of the image forming apparatus main body 12, arrayed in the direction orthogonal to the conveyance direction. Note that the external sheet supply device 16 will be described in detail later.

The post processing devices 18*a* and 18*b* have sorters 60*a* and 60*b*, staplers (not shown) and the like. The post processing devices 18*a* and 18*b* receive sheets discharged from the image forming apparatus main body 12, perform sheet sorting processing or the like and discharge the sheets to the discharge tray (not shown). A sheet conveyance belt 44 is movably put in e.g. a position above the post processing device 18*a* and between the image forming apparatus main body 12 and the post processing device 18*b*. The sheet conveyance belt 44 conveys sheets, discharged from the image forming apparatus main body 12 onto the left side or the right side of the sheet conveyance direction, to the post processing device 18*b*. In the present exemplary embodiment, the sheet conveyance belt 44 conveys sheets discharged on the left side of the sheet conveyance direction to the post processing device 18*b*. The post processing devices 18*a* and 18*b* are selected based on a setting content inputted via an input-display 56 to be described later or a print job transmitted via a network (not shown). In this manner, the post processing devices 18*a* and 18*b* perform post processing on mutually different sheets, among plural sheets on which images are formed with the image forming part 26. Note that the post processing devices

18*a* and 18*b* and the sheet conveyance belt 44 may be included in the same case. Further, the post processing devices 18*a* and 18*b* and the sheet conveyance belt 44 will be described in detail later.

The image reading device 14 has an automatic document feeding device 50 such as an ADF (Auto Document Feeder) and a scanner 52 to read-scan an image sent from the automatic document feeding device 50. A sheet is sent from the automatic document feeding device 50 to a platen 54, and an image on the sheet is read with the scanner 52 on the platen 54. When copying is set with the image forming apparatus 10, the image read in the image reading device 14 is print-outputted with the image forming apparatus main body 12 thus the image is duplicated.

The input-display (UI) 56, having e.g. a touch panel, is provided in e.g. an upper part of the image forming apparatus main body 12. The UI part 56 receives an input from an operator, selects processing contents in the image forming apparatus main body 12, the image reading device 14, the external sheet supply device 16 and the post processing devices 18*a* and 18*b* and displays the selected processing contents.

Figure 4A:
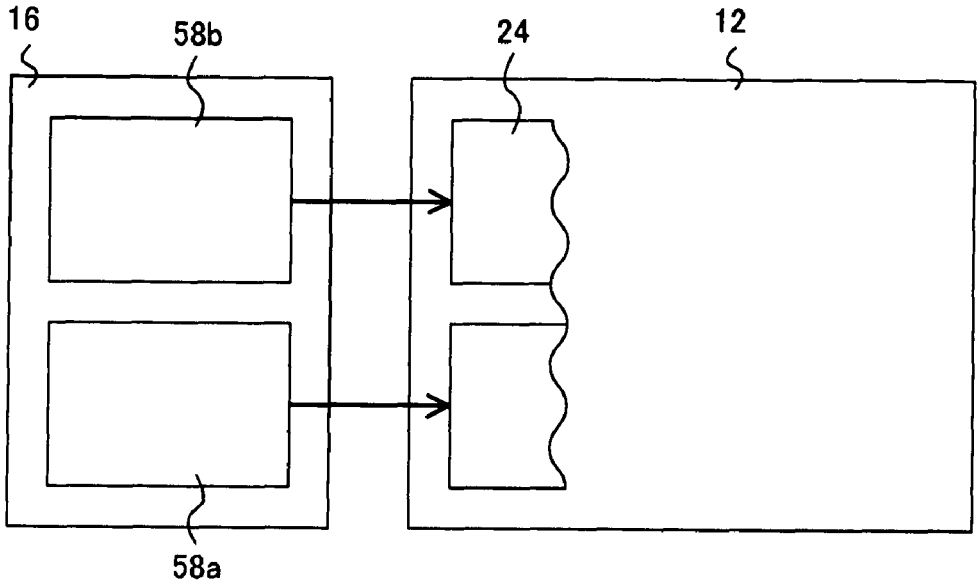
FIGS. 4A and 4B are explanatory views showing the positional relation among sheet supply parts 58*a* to 58*d* in an external sheet supply device 16 of the image forming apparatus 10.
Figure 4B:
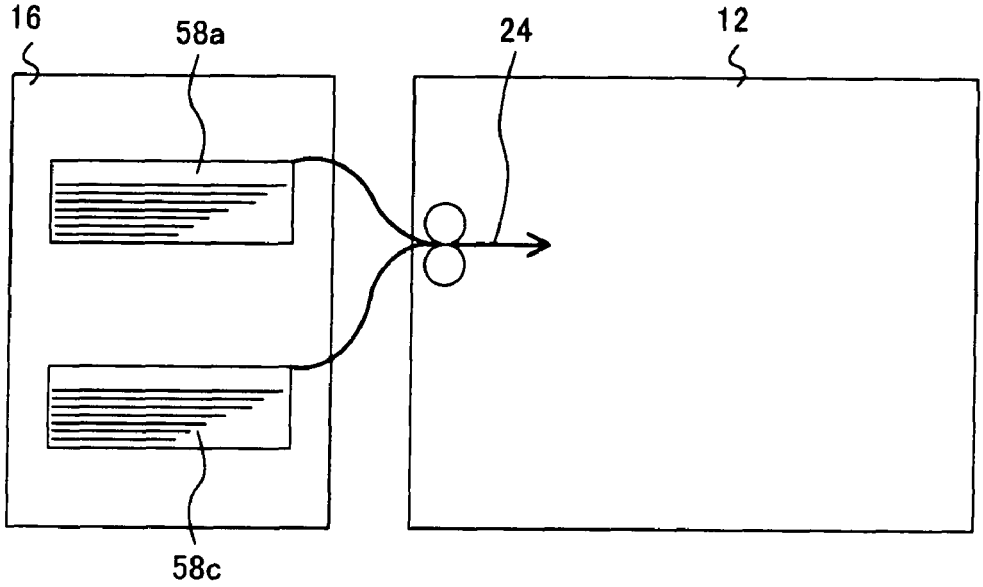

FIGS. 4A and 4B are explanatory views showing the positional relation among the sheet supply parts 58*a* to 58*d* in the external sheet supply device 16 of the image forming apparatus 10 according to the present exemplary embodiment. FIG. 4A shows the positional relation when the external sheet supply device 16 is viewed from an upper position. FIG. 4B shows the positional relation when the external sheet supply device 16 is viewed from a direction the same as the direction shown in FIG. 3.

As shown in FIGS. 4A and 4B, the sheet supply part 58*a* is provided on the right side to the sheet conveyance path 24 of the image forming apparatus main body 12. The sheet supply part 58*c* is provided below the sheet supply part 58*a*. The sheet supply part 58*b* is provided on the left side to the sheet conveyance path 24 of the image forming apparatus main body 12. The sheet supply part 58*d* is provided below the sheet supply part 58*c*.

Figure 5:
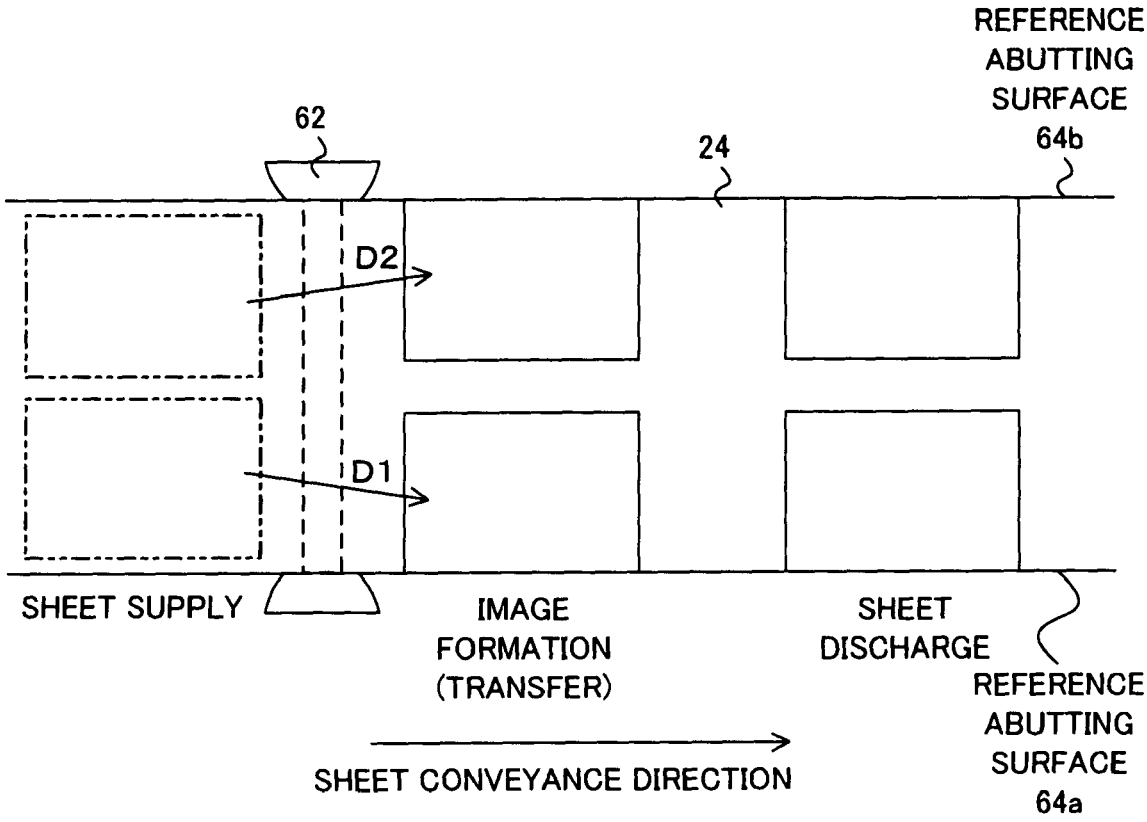
FIG. 5 is an explanatory view showing positioning of sheets in the image forming apparatus 10.

FIG. 5 is an explanatory view showing positioning of sheets in the image forming apparatus 10 according to the present exemplary embodiment.

As shown in FIG. 5, when plural sheets are conveyed in parallel, the plural sheets are positioned with different directions to the conveyance direction as reference abutting directions. More particularly, when a sheet is conveyed on the right side to the conveyance direction of the sheet conveyance path 24, the sheet is positioned with reference to a first reference abutting surface 64*a* (front side). When the sheet is conveyed on the left side to the conveyance direction, the sheet is positioned with reference to a second reference abutting surface 64*b* (back side).

In the present exemplary embodiment, the image forming apparatus 10 has a conveyance roller 62 (positioning member) to perform positioning on end surfaces of conveyed plural sheets based on end surfaces of the plural sheets in different directions. Upon conveyance of sheets conveyed on the sheet conveyance path 24, the conveyance roller 62 conveys the sheets in leftward or rightward direction, to abut the ends of the sheets on the reference abutting surface 64*a* or 64*b*. For example, as indicated with an arrow D1 in FIG. 5, the conveyance roller 62 conveys a sheet conveyed on the right side of the sheet conveyance path 24 into a direction so as to abut the sheet on the first reference abutting surface 64*a*. Further, as indicated with an arrow D2 in FIG. 5, the conveyance roller 62 conveys a sheet conveyed on the left side of the sheet conveyance path 24 into a direction so as to abut the sheet on the second reference abutting surface 64*b*. Note that the conveyance roller 62 may be provided in plural positions on the sheet conveyance path 24.

Figure 6:
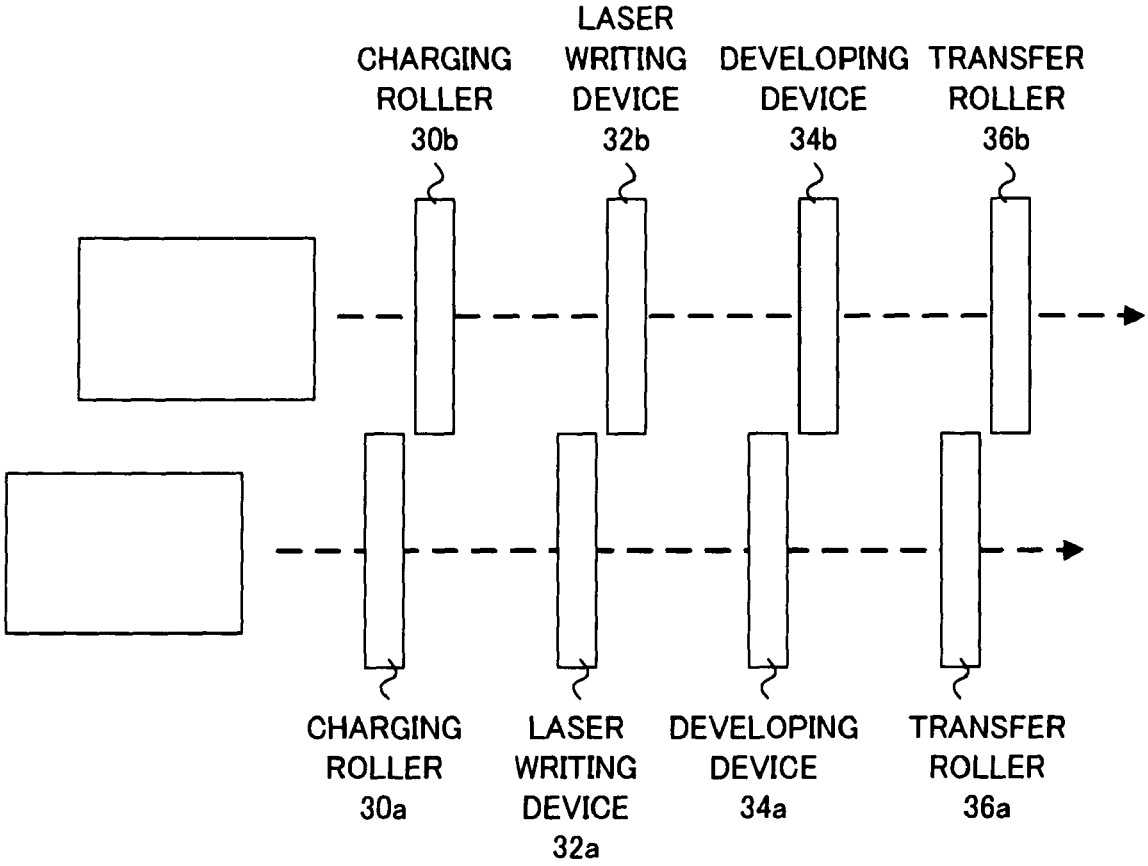
FIG. 6 is an explanatory view showing timings of image forming processing in the image forming apparatus 10.

FIG. 6 is an explanatory view showing timings of image forming processing in the image forming apparatus 10 according to the present exemplary embodiment.

As shown in FIG. 6, the image forming apparatus 10 has independent plural image forming processes. In this example, one image forming process includes processing with the charging roller 30*a*, the laser writing device 32*a*, the developing device 34*a* and the transfer roller 36*a*, and the other image forming process includes processing with the charging roller 30*b*, the laser writing device 32*b*, the developing device 34*b* and the transfer roller 36*b*.

In the respective image forming processes, the timing (time) of image forming processing is controlled by a controller to be described later. In the plural image forming processes, the image forming apparatus 10 may form images at the same timing or may form images at different timings on plural sheets. For example, the image forming apparatus 10 simultaneously forms images on plural A4 sheets and plural A3 sheets, or A4SEF and A4LEF sheets, conveyed in parallel. Further, for example, the image forming apparatus 10 forms images at different timings on plural A4 sheets conveyed in parallel with ends shifted from each other, or A4LEF and A3SEF sheets conveyed in parallel.

Note that the developing devices 34*a* and 34*b* may be arrayed in the axial direction of the image holder 28, or may be shifted from each other. The charging rollers 30*a* and 30*b*, the laser writing devices 32*a* and 32*b* and the transfer rollers 36*a* and 36 may also be arrayed in the axial direction of the image holder 28 or may be shifted from each other. In the image forming apparatus 10, when the developing devices 34*a* and 34*b* and the like are arrayed in the axial direction of the image holder 28, timings of image formation on plural sheets conveyed in parallel may be shifted thereby the sheets may be discharged at intervals.

Figure 7A:
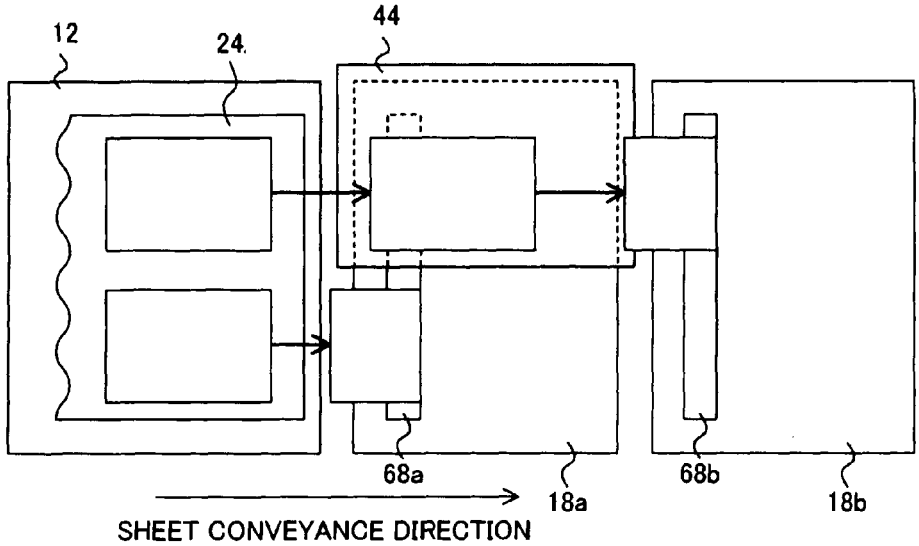
FIGS. 7A to 7C are explanatory views explaining post processing devices 18*a* and 18*b* and a sheet conveyance belt 44 of the image forming apparatus 10.
Figure 7B:
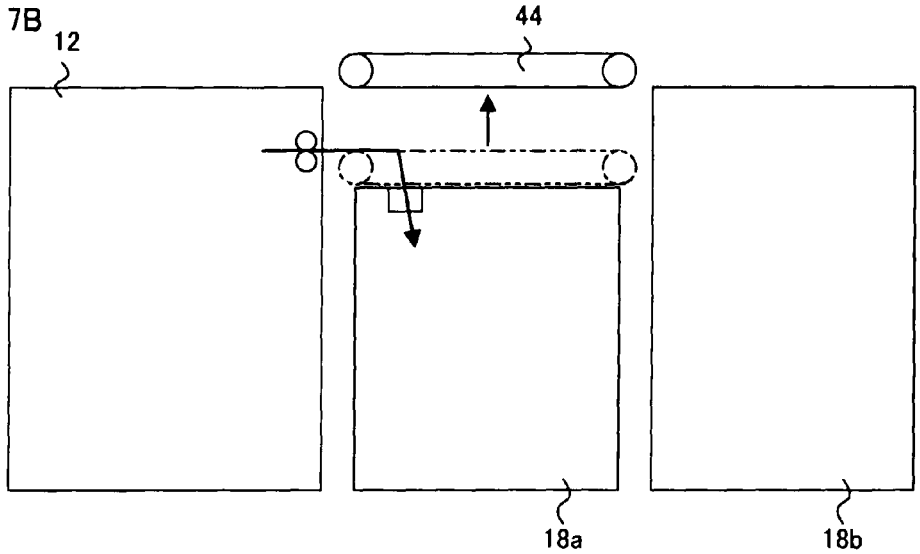
Figure 7C:
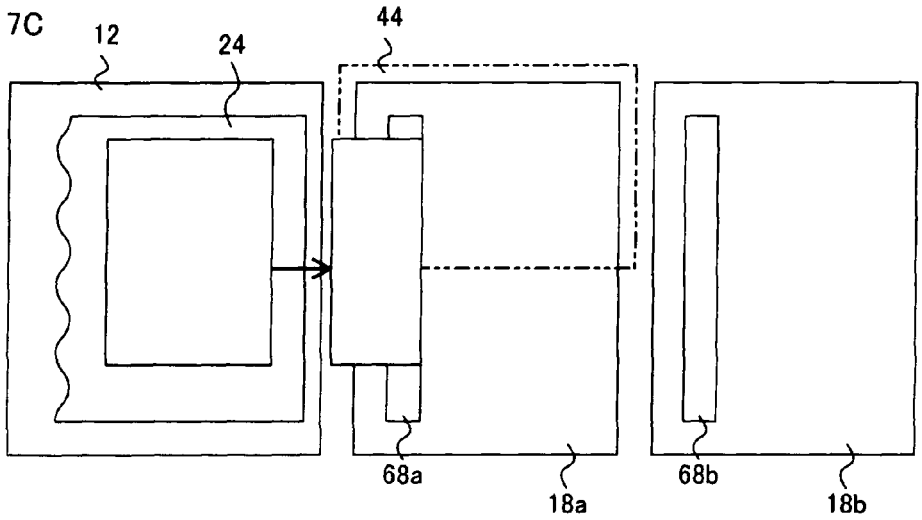

FIGS. 7A to 7C are explanatory views explaining the post processing devices 18*a* and 18*b* and the sheet conveyance belt 44 of the image forming apparatus 10.

FIG. 7A schematically shows plural sheets conveyed in parallel from the image forming apparatus main body 12 to the post processing devices 18*a* and 18*b*. In the present exemplary embodiment, as shown in FIG. 7A, the sheet conveyed on the right side to the conveyance direction is discharged from the image forming apparatus main body 12, then, via the reception port 68*a* of the post processing device 18*a*, received in the post processing device 18*a*. On the other hand, the sheet conveyed on the left side to the conveyance direction is discharged from the image forming apparatus main body 12, then conveyed by the sheet conveyance belt 44, and, via the reception port 68*b* of the post processing device 18*b*, received in the post processing device 18*b*. Accordingly, the plural sheets conveyed in parallel and discharged from the image forming apparatus main body 12 are subjected to post processing with the different post processing devices 18*a* and 18*b*.

FIG. 7B shows the movement of the sheet conveyance belt 44. As shown in FIG. 7B, the sheet conveyance belt 44 is moved by a sheet conveyance belt moving unit (not shown) from a sheet conveyance path from the image forming apparatus main body 12 to the post processing device 18*b* to a position different from the sheet conveyance path. For example, the sheet conveyance belt 44 is moved from the sheet conveyance path to an upper position.

FIG. 7C shows a sheet conveyed from the image forming apparatus main body 12 to the post processing device 18*a* in a status where the sheet conveyance belt 44 is moved to a position different from the sheet conveyance path. As shown in FIG. 7C, when the sheet is discharged from the image forming apparatus main body 12 in the status where the sheet conveyance belt 44 is moved to the position different from the sheet conveyance path, the sheet is conveyed to the post processing device 18*a*.

Figure 8:
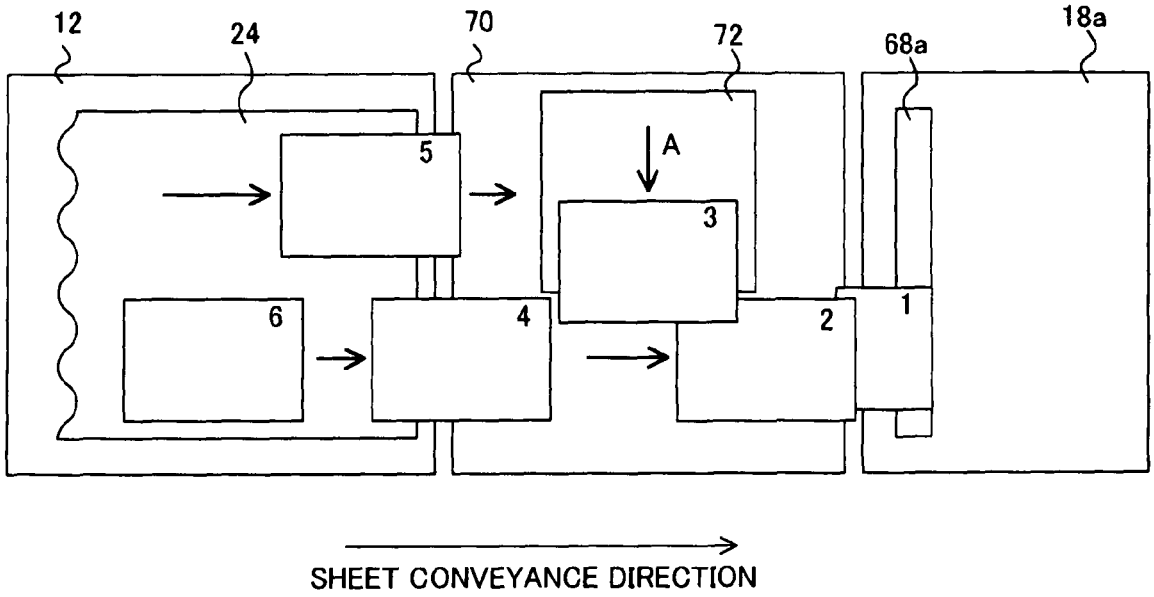
FIG. 8 is an explanatory view showing another example of conveyance of sheets discharged from an image forming apparatus main body 12 to the post processing device 18*a;*

FIG. 8 is an explanatory view showing another example of conveyance of a sheet discharged from the image forming apparatus main body 12 to the post processing device 18*a*.

As shown in FIG. 8, in the image forming apparatus 10, sheet conveyance belts 70 and 72 are movably provided between the image forming apparatus main body 12 and the post processing device 18*a*. In this case, the sheet conveyance belt 70 conveys a sheet discharged from the image forming apparatus main body 12 to the post processing device 18*a*. Further, as indicated with an arrow A in FIG. 8, the sheet conveyance belt 72 conveys a sheet discharged from the image forming apparatus main body 12 in a direction orthogonal to a sheet conveyance direction of the sheet conveyance belt 70. More particularly, the sheet conveyance belt 72 moves the sheet, discharged on the left side to the sheet conveyance direction of the image forming apparatus main body 12, to the right side of the sheet conveyance direction.

In this example, sheets 2, 4 and 6 are conveyed on the right side of the sheet conveyance direction of the image forming apparatus main body 12 and discharged, and conveyed with the sheet conveyance belt 70 to the post processing device 18*a*. Sheets 1, 3 and 5 are conveyed on the left side of the sheet conveyance direction and discharged, and conveyed with the sheet conveyance belt 70 to the post processing device 18*a*. During this conveyance processing, the sheets 1, 3 and 5 are moved with the sheet conveyance belt 72 to the right side of the sheet conveyance direction.

Accordingly, when plural arrayed sheets are conveyed in parallel, with their ends in different positions in the sheet conveyance direction as shown in FIG. 2C, the plural sheets are rearranged in discharge order and conveyed to the post processing device 18*a* with the sheet conveyance belts 70 and 72.

Note that the sheet conveyance belts 44, 70 and 72 are moved to predetermined positions in accordance with contents of settings at the UI part 56 or contents of print job. In this case, the sheet conveyance belts 44, 70 and 72 are moved by the controller to be described later based on sheet size, execution/non-execution of sort processing, execution/non-execution of parallel image forming processing and the like.

Figure 9:
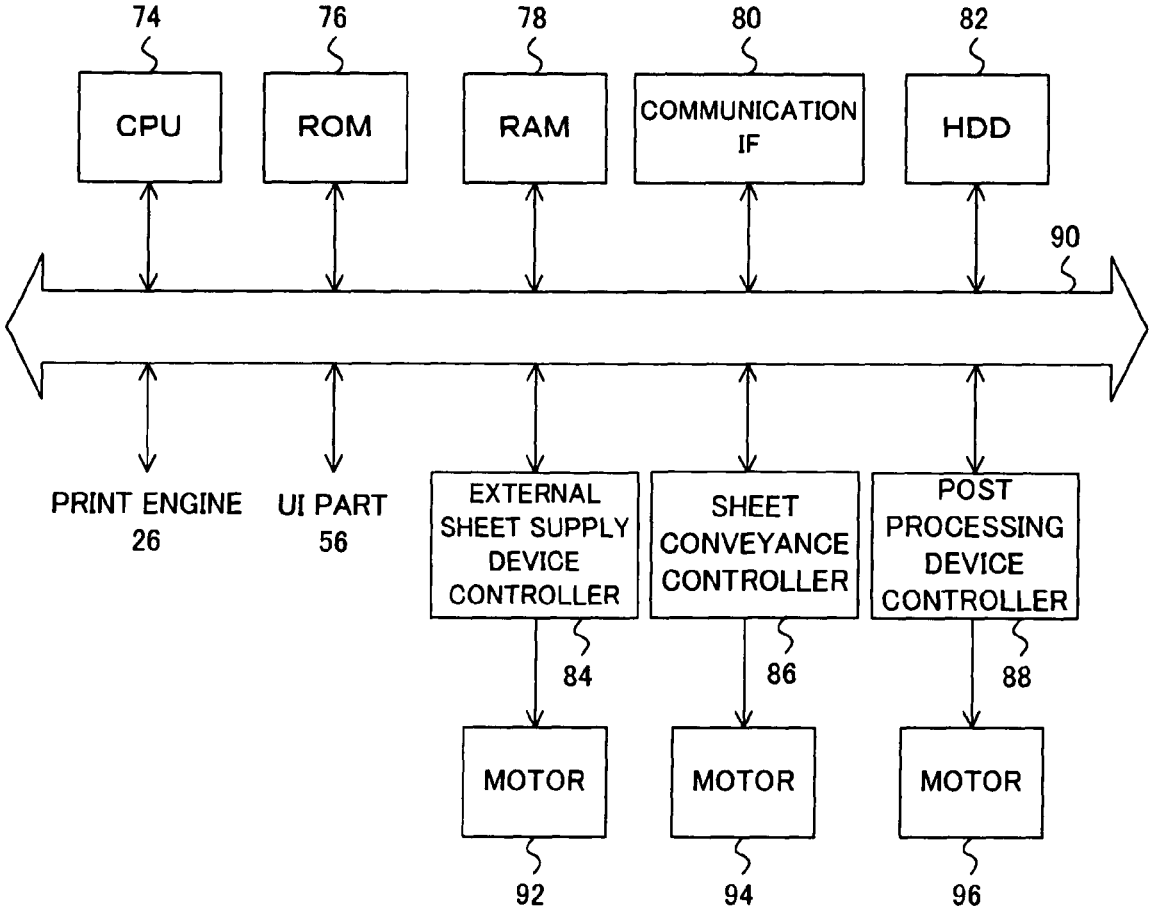
FIG. 9 is a block diagram showing a controller of the image forming apparatus 10.

FIG. 9 is a block diagram showing the controller of the image forming apparatus 10 according to the present exemplary embodiment of the present invention.

As shown in FIG. 9, the image forming apparatus 10 has a CPU 74, a ROM 76, a RAM 78, a communication interface (IF) 80, a hard disk drive (HDD) 82, an external sheet supply device controller 84, a sheet conveyance controller 86, a post processing device controller 88 and motors 92, 94 and 96. In the controller, these constitute elements mutually input/output signals via a system bus 90.

The CPU 74 transmits/receives signals with other constituent elements of the controller and the respective constituent elements of the image forming apparatus main body 12 via the system bus 90, and controls the respective constituent elements of the image forming apparatus main body 12. The ROM 76, which is e.g. a nonvolatile memory, holds data such as a control program to control the image forming apparatus main body 12. The ROM 76 outputs the stored data via the system bus 90 to the CPU 74 or the like by access from the CPU 74.

The RAM 78 holds data to control the image forming apparatus main body 12 for the CPU 74, data transmitted from other computers and the like via the network (not shown) such as a print job, image data mapped based on a print job, data received from the image reading device 14, the external sheet supply device 16 and the post processing devices 18*a* and 18*b*, and the like. The communication IF 80 performs data transmission/reception with the other computers and the like via the network (not shown). The HDD 82 holds data such as image data as in the case of the RAM 78.

The external sheet supply device controller 84 inputs/outputs signals with the CPU 74 via the system bus 90, and controls the respective supply heads 22 of the sheet supply parts 58*a* to 58*d*, the conveyance roller and the like via the motor 92 under the control of the CPU 74. The motor 92 drives the supply heads 22 and the conveyance roller and the like under the control of the external sheet supply device controller 84. The sheet conveyance controller 86 controls the supply heads 22, the conveyance roller 62, the sheet conveyance belts 44, 70, 72 and the like via the motor 94 also under the control of the CPU 74. The motor 94 drives the supply heads 22, the conveyance roller 62, the sheet conveyance belts 44, 70, 72 and the like. The post processing device controller 88 controls the sorters 60*a*, 60*b* and the like via the motor 96 also under the control of the CPU 74. The motor 96 drives the sorters 60*a*, 60*b* and the like.

Next, the advantages of the above exemplary embodiment will be described.

When an operator A transmits a print request A to the image forming apparatus 10 using an external terminal device such as a personal computer, the image forming apparatus 10 receives the transmitted print request A via the communication IF 80. The print request includes data on print processing such as transmission source information, a sheet size, the number of printed sheets, document data expressed in a predetermined page description language. The image forming apparatus 10 receives the print request A to print e.g. an A4 document having plural pages from the external terminal device. On the other hand, when an operator B transmits a print request B to print e.g. an A3 document having plural pages to the image forming apparatus 10 using an external terminal device, the image forming apparatus 10 receives the transmitted print request B.

In the image forming apparatus 10, the CPU 74 maps an image A based on the document data included in the received print request A, and stores the mapped image A into at least one of the RAM 78 and HDD 82. Similarly, the CPU 74 maps an image B based on document data included in the print request B and stores the mapped image B into the RAM 78 or the like.

The CPU 74 controls the external sheet supply device controller 84 to supply e.g. an A4LEF sheet from the sheet supply part 58*a* and an A3SEF sheet from the sheet supply part 58*b*. The A4LEF sheet and the A3SEF sheet are conveyed to the conveyance roller and supplied from the external sheet supply device 16 to the image forming apparatus main body 12.

The image holder 28 is charged with the charging rollers 30*a* and 30*b*. Then, on the charged image holder 28, a latent image based on the image A is written with the laser writing device 32*a*, and a latent image based on the image B is written with the laser writing device 32*b* in a position different from the position of the latent image based on A. These latent images are developed with the developing devices 34*a* and 34*b*.

The A4LEF sheet and the A3SEF sheet are conveyed on the sheet discharge path 42 at predetermined timings. A developing material image based on the image A is fixed with the fixing device 40*a* to the A4LEF sheet, and a developing material image based on the image B is fixed with the fixing device 40*b* to the A3SEF sheet. These sheets are discharged from the image forming apparatus main body 12. In this manner, the A4 document and the A3 document are printed by a predetermined number of sheets.

The A4LEF sheets are directly supplied from the image forming apparatus main body 12 to the post processing device 18*a*, then subjected to sort processing, staple processing and the like by the post processing device 18*a*, and discharged. The A3SEF sheets are conveyed with the sheet conveyance belt 44 and are supplied to the post processing device 18*b*, then subjected to sort processing and the like by the post processing device 18*b*, and discharged.

Note that the print request is not limited to a request transmitted from the external terminal device and may be a print job using the facsimile function or the copier function. For example, a sheet subjected to printing using the copier function, a sheet subjected to printing using the facsimile function and a sheet subjected to printing using the printer function may be conveyed in parallel and subjected to image formation.

Further, the sheet supply parts 20 may be provided as in the case of the sheet supply parts 58 *a* to 58*d* of the external sheet supply device 16, in right and left columns and upper and lower stages. In this case, the sheet supply parts 20 may supply plural sheets in parallel to the sheet conveyance path 24.

Next, a second exemplary embodiment of the present invention will be described.

Figure 10:
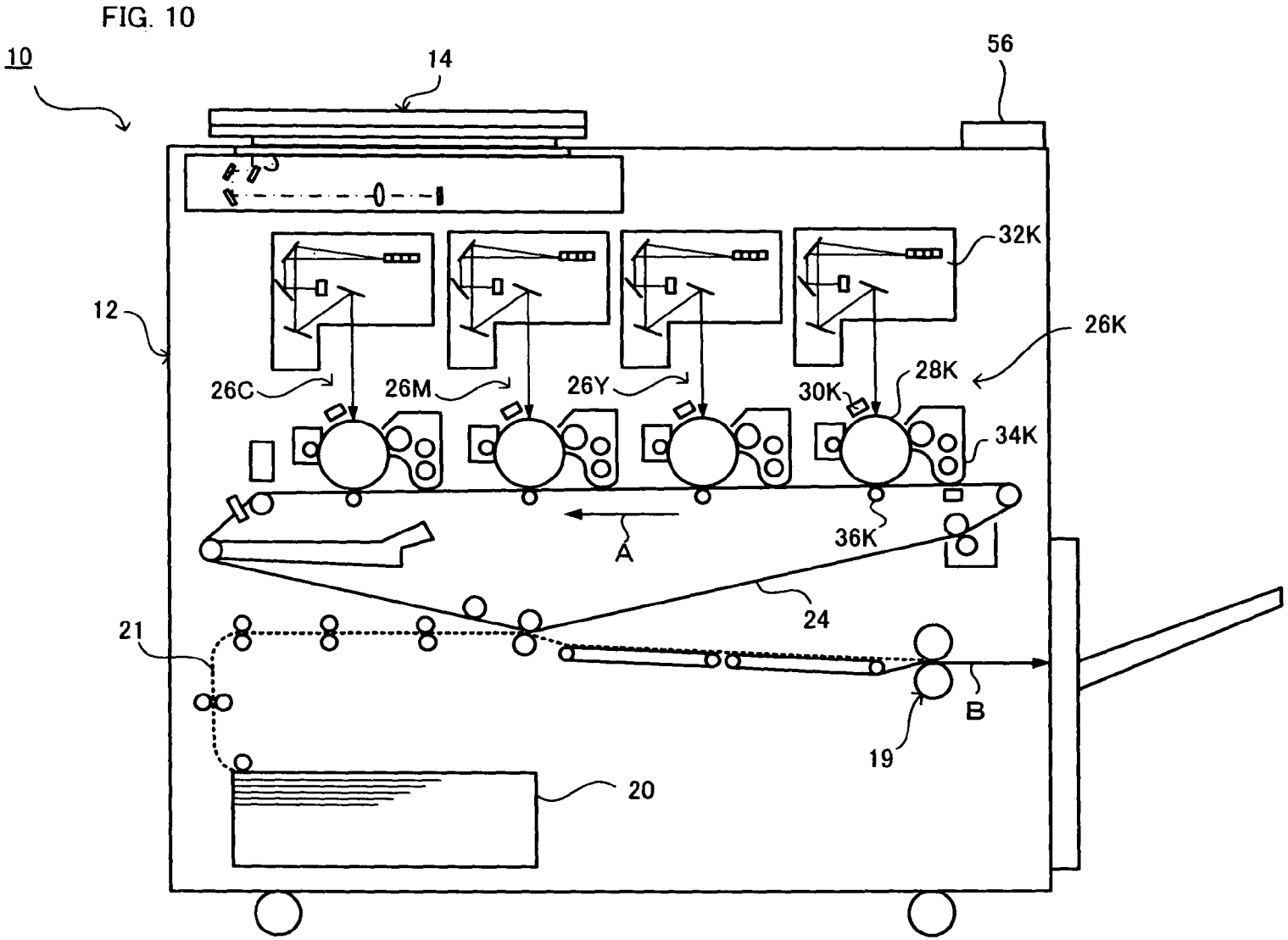
FIG. 10 is a cross-sectional view schematically showing the structure of the image forming apparatus 10 according to a second exemplary embodiment of the present invention.

FIG. 10 is a cross-sectional view schematically showing the structure of the image forming apparatus 10 according to the second exemplary embodiment of the present invention. Note that among respective constituent elements shown in FIG. 10, elements corresponding to those shown in FIG. 3 have the same reference numerals.

As shown in FIG. 10, the image forming apparatus 10 according to the present exemplary embodiment has the image forming apparatus main body 12, the image reading device 14, plural image forming units 26K, 26Y, 26M and 26C, an intermediate transfer belt 24, the sheet supply part 20, a sheet conveyance path 21, a fixing unit 19 and the UI part 56.

The plural image forming units 26K, 26Y, 26M and 26C corresponding to colors for color image formation are provided below the image reading device 14. In the present exemplary embodiment, in correspondence with black (K), yellow (Y), magenta (M) and cyan (C) colors, the first image forming part 26K, the second image forming part 26Y, the third image forming part 26M and the fourth image forming part 26C are arranged, respectively in two positions, along the intermediate transfer belt 24, at predetermined intervals. The two first image forming units 26K are arranged in parallel in a direction orthogonal to a sheet conveyance direction of the intermediate transfer belt 24 to be described later. Similarly, the second image forming part 26Y, the third image forming part 26M and the fourth image forming part 26C are arranged in respectively two positions in parallel.

The intermediate transfer belt 24 conveys plural sheets from the sheet supply part 20 or the external sheet supply device 16 (not shown) in parallel. More particularly, the intermediate transfer belt 24 as an intermediate transfer body rotates in an arrow A direction in FIG. 10, and these four image forming units 26K, 26Y, 26M and 26C sequentially form respective color developing material images based on input image data, and transfer these plural developing material images onto the intermediate transfer belt 24 at timings so as to overlay the developing material images.

The sheet conveyance path 21 is provided below the intermediate transfer belt 24. A sheet supplied from the sheet supply part 20 is conveyed on the sheet conveyance path 21, then the respective color developing material images overlay-transferred on the intermediate transfer belt 24 are transferred onto the sheet at a time, then the transferred developing material image is fixed with the fixing unit 19 to the sheet, and the sheet is discharged along an arrow B to the outside. Note that the width of the intermediate transfer belt 24 and that of the sheet conveyance path 21 are wider than the width of the plural sheets arrayed in parallel.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder;

a writing device that writes a latent image in different positions in an axial direction of the image holder at different times;

a conveyance unit that conveys a plurality of single cut-sheet recording media arrayed along a direction orthogonal to a conveyance direction; and an image forming unit that forms an image on the plurality of single cut-sheet recording media conveyed by the conveyance unit, wherein a rear end of a single-cut recording media and a front end of a next single-cut recording media are arranged as to overlap each other in the direction orthogonal to the conveyance direction.

2. The image forming apparatus according to claim 1, wherein the image forming unit forms the image at the same timing on the respective plurality of single cut-sheet recording media.

3. The image forming apparatus according to claim 1, wherein the image forming unit forms the image at different timings on the respective plurality of single cut-sheet recording media.

4. The image forming apparatus according to claim 1, wherein the image forming unit has:

a developing device that develops the latent image written by the writing device; and a transfer device that transfers a developing material image developed by the developing device to the single cut-sheet recording media conveyed by the conveyance unit, and the writing device, the developing device and the transfer device are provided in a plurality of positions respectively.

5. The image forming apparatus according to claim 1, further comprising a single cut-sheet recording medium supply device that arrays the plurality of single cut-sheet recording media conveyed by the conveyance unit in the direction orthogonal to the conveyance direction and supplies the plurality of single cut-sheet recording media.

6. The image forming apparatus according to claim 1, further comprising a plurality of post processing devices that perform post processing on mutually different single cut-sheet recording media among the plurality of single cut-sheet recording media on which the image is formed by the image forming unit.

7. The image forming apparatus according to claim 1, further comprising a positioning member that performs positioning on edges of the plurality of single cut-sheet recording media conveyed by the conveyance unit based on the edges of the plurality of single cut-sheet recording media in different directions.

8. The image forming apparatus according to claim 1, wherein the conveyance unit conveys the plurality of single cut-sheet recording media in different sizes in parallel.

9. The image forming apparatus according to claim 8, wherein the conveyance unit conveys a single cut-sheet recording medium in a first size with the medium's short side along the conveyance direction, and conveys a single cut-sheet recording medium in a second size with the medium's long side along the conveyance direction.

10. The image forming apparatus according to claim 9, wherein the conveyance unit conveys the single cut-sheet recording medium in the second size larger than the first size, with the long side of which along the conveyance direction.

11. An image forming apparatus comprising:

an image holder;

a writing device that writes a latent image in different positions in an axial direction of the image holder at different times;

a supply device that supplies a plurality of single cut-sheet recording media in parallel with each other;

a conveyance member that conveys the plurality of single cut-sheet recording media arrayed along a direction orthogonal to a conveyance direction;

a driving device that drives the conveyance member; and an image forming part that forms an image on the plurality of single cut-sheet recording media conveyed by the conveyance member, wherein a rear end of a single-cut recording media and a front end of a next single-cut recording media are arranged as to overlap each other in the direction orthogonal to the conveyance direction.

12. The image forming apparatus according to claim 11, further comprising a plurality of post processing devices that performs post processing on mutually different single cut-sheet recording media among the plurality of single cut-sheet recording media on which the image is formed by the image forming part.

* * * * *